US009373435B2

(12) United States Patent
Odahara

(10) Patent No.: US 9,373,435 B2
(45) Date of Patent: Jun. 21, 2016

(54) ELECTRONIC COMPONENT AND METHOD FOR MANUFACTURING THE SAME

(71) Applicant: MURATA MANUFACTURING CO., LTD., Kyoto (JP)

(72) Inventor: Mitsuru Odahara, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/678,731

(22) Filed: Apr. 3, 2015

(65) Prior Publication Data

US 2015/0213947 A1 Jul. 30, 2015

Related U.S. Application Data

(62) Division of application No. 13/651,114, filed on Oct. 12, 2012, now Pat. No. 9,099,235.

(30) Foreign Application Priority Data

Oct. 14, 2011 (JP) ..... 2011-226472

(51) Int. Cl.
*H01F 5/00* (2006.01)
*H01F 17/00* (2006.01)
*H01F 27/28* (2006.01)

(52) U.S. Cl.
CPC ..... *H01F 17/0013* (2013.01); *H01F 5/00* (2013.01); *H01F 27/2804* (2013.01); *H01F 17/0033* (2013.01); *H01F 2017/0066* (2013.01); *H01F 2027/2809* (2013.01); *Y10T 29/49071* (2015.01)

(58) Field of Classification Search
CPC ..... H01F 5/00; H01F 27/00–27/30
USPC ..... 336/65, 83, 200, 206–208, 233–234
See application file for complete search history.

(56) References Cited

U.S. PATENT DOCUMENTS 5,250,923 A * 10/1993 Ushiro ..... H01F 17/0013 333/184
6,008,151 A 12/1999 Sasaki et al.
7,034,637 B2 4/2006 Kono et al.
7,907,044 B2 3/2011 Tada et al.
2004/0207488 A1 10/2004 Kono et al.

(Continued)

FOREIGN PATENT DOCUMENTS

CN 101390176 A 3/2009
CN 101772994 A 7/2010

(Continued)

OTHER PUBLICATIONS

Korean Office Action; KR10-2012-0113292; Oct. 24, 2013.

(Continued)

*Primary Examiner* — Tuyen Nguyen
(74) *Attorney, Agent, or Firm* — Studebaker & Brackett PC

(57) ABSTRACT

A laminate has a structure in which magnetic layers and a non-magnetic layer containing glass are stacked. A coil is incorporated in the laminate. The magnetic permeability μ2 in portions (low-magnetic-permeability portions), of the magnetic layers, which are adjacent to the non-magnetic layer and into which the glass diffuses is lower than the magnetic permeability μ1 in portions (high-magnetic-permeability portions), of the magnetic layers, which are not adjacent to the non-magnetic layer.

2 Claims, 10 Drawing Sheets

(56) References Cited

U.S. PATENT DOCUMENTS

| | | | |
|---|---|---|---|
| 2010/0112284 | A1 | 5/2010 | Iida et al. |
| 2011/0036622 | A1 | 2/2011 | Chikagawa et al. |
| 2011/0128109 | A1 | 6/2011 | Tada et al. |

FOREIGN PATENT DOCUMENTS

| | | | |
|---|---|---|---|
| CN | 101998779 | A | 3/2011 |
| JP | H04-142714 | A | 5/1992 |
| JP | H05-190363 | A | 7/1993 |
| JP | H10-338545 | A | 12/1998 |
| JP | 2000-331831 | A | 11/2000 |
| JP | 2004-343084 | A | 12/2004 |
| JP | 2005-310959 | A | 11/2005 |
| JP | 2006-318946 | A | 11/2006 |
| JP | 2007-200923 | A | 8/2007 |
| JP | 2007-281025 | A | 10/2007 |
| JP | 2007-324554 | A | 12/2007 |
| KR | 10-2008-0007311 | A | 1/2008 |

OTHER PUBLICATIONS

Korean Office Action; KR10-2012-0113292; Mar. 3, 2014.
Chinese Office Action; CN201210385885.2; Nov. 3, 2014.

* cited by examiner

ELECTRONIC COMPONENT AND METHOD FOR MANUFACTURING THE SAME

CROSS REFERENCE TO RELATED APPLICATION

The present application claims priority from Japanese Patent Application No. 2011-226472 filed on Oct. 14, 2011, the entire contents of which are hereby incorporated by reference into this application.

TECHNICAL FIELD

The technical field relates to an electronic component and a method for manufacturing the electronic component, and more particularly to an electronic component with a coil incorporated therein and a method for manufacturing the electronic component.

BACKGROUND

As a conventional electronic component, a multilayer inductor disclosed in Japanese Unexamined Patent Application Publication No. 2006-318946 (hereinafter referred to as "a conventional multilayer inductor") has been known. FIG. 10 is a sectional view showing a structure of a conventional multilayer inductor 500.

The multilayer inductor 500 includes a laminate 502 and a coil 504. The laminate 502 has a structure in which a plurality of magnetic layers 506 and non-magnetic layers 508 are stacked. The coil 504 is incorporated in the laminate 502 and is formed by connecting coil conductors in series through via-hole conductors.

In the multilayer inductor 500 described above, the generation of magnetic saturation in the laminate 502 is suppressed by forming the non-magnetic layers 508. As a result, the multilayer inductor 500 has excellent direct-current superposition characteristics.

In the multilayer inductor 500, there has been a demand for further improving direct-current superposition characteristics.

SUMMARY

The present disclosure provides an electronic component having excellent direct-current superposition characteristics and a method for manufacturing the electronic component.

In one aspect, the present disclosure provides an electronic component that includes a laminate in which magnetic layers and at least one non-magnetic layer containing glass are stacked and a coil incorporated in the laminate. A second magnetic permeability in portions of the magnetic layers, which are adjacent to the non-magnetic layer, is lower than a first magnetic permeability in portions of the magnetic layers which are not adjacent to the non-magnetic layer, by diffusion of the glass from the non-magnetic layer to the magnetic layers.

In another aspect, the present disclosure provides a method for manufacturing an electronic component including steps of forming coil conductors of the coil on the magnetic layers, forming the non-magnetic layer on the magnetic layers, forming the laminate by stacking the magnetic layers, and firing the formed laminate.

DETAILED DESCRIPTION

An electronic component according to an exemplary embodiment and a method for manufacturing the electronic component will now be described with reference to the drawings.

Figure 1:
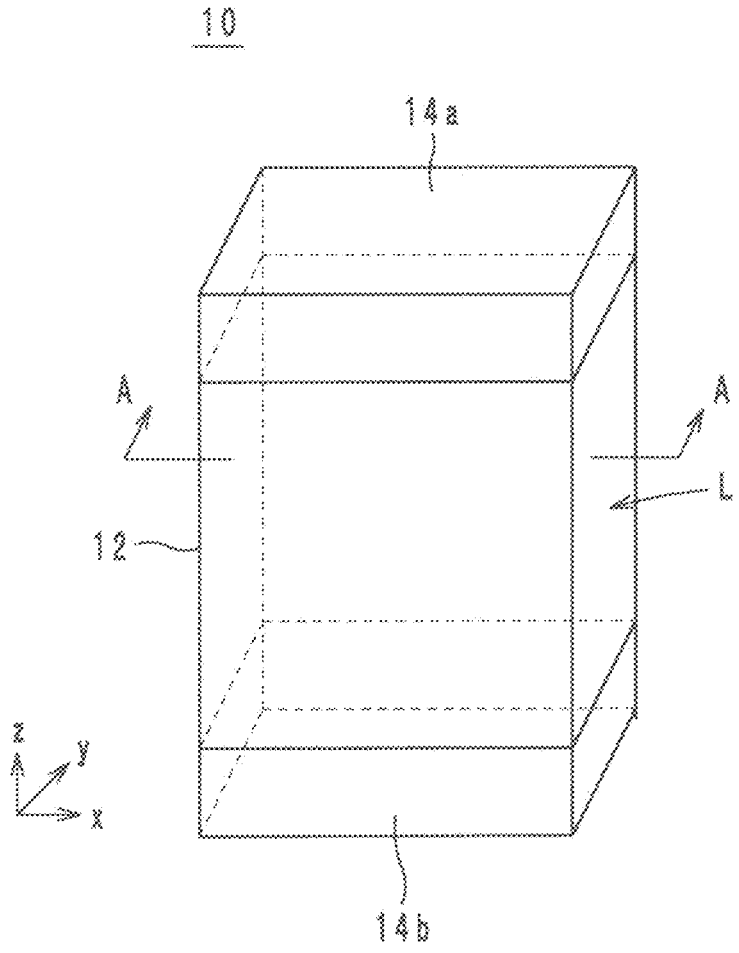
FIG. 1 is an external perspective view of an electronic component according to an exemplary embodiment.
Figure 2:
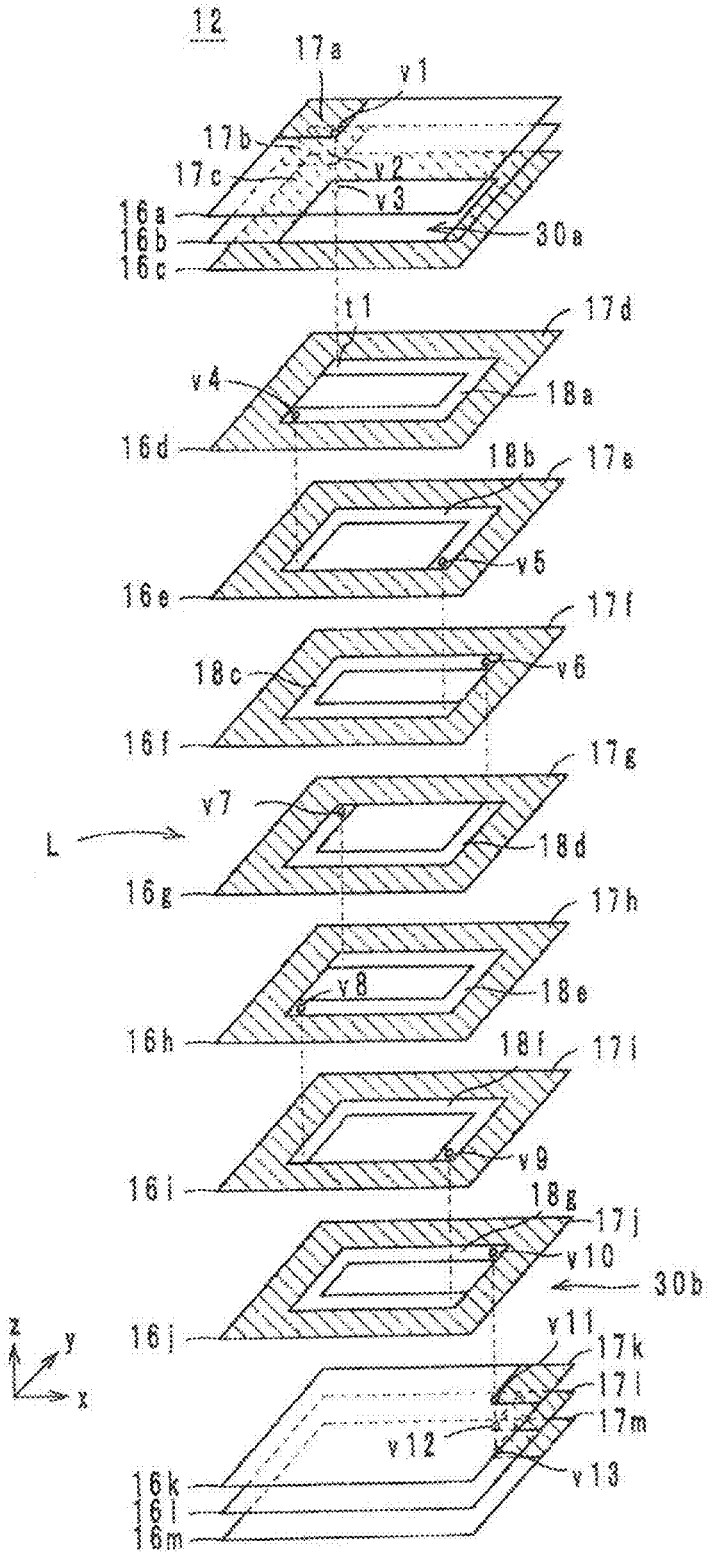
FIG. 2 is an exploded perspective view of a laminate of the electronic component shown in FIG. 1.
Figure 3A:
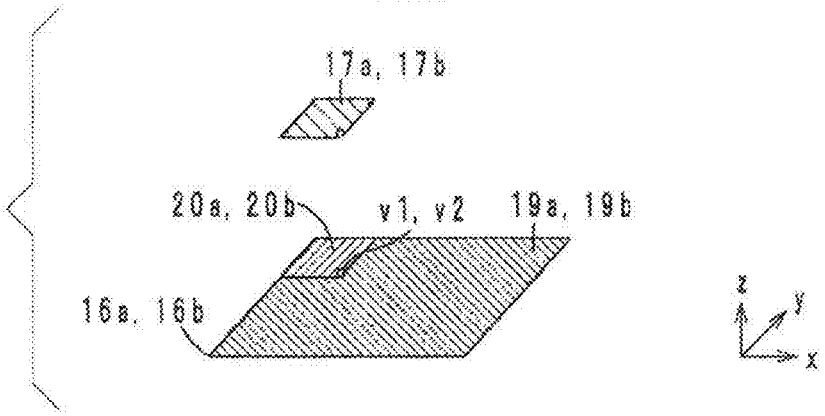
FIG. 3A is an exploded perspective view of a first magnetic layer of the laminate shown in FIG. 2.
Figure 3B:
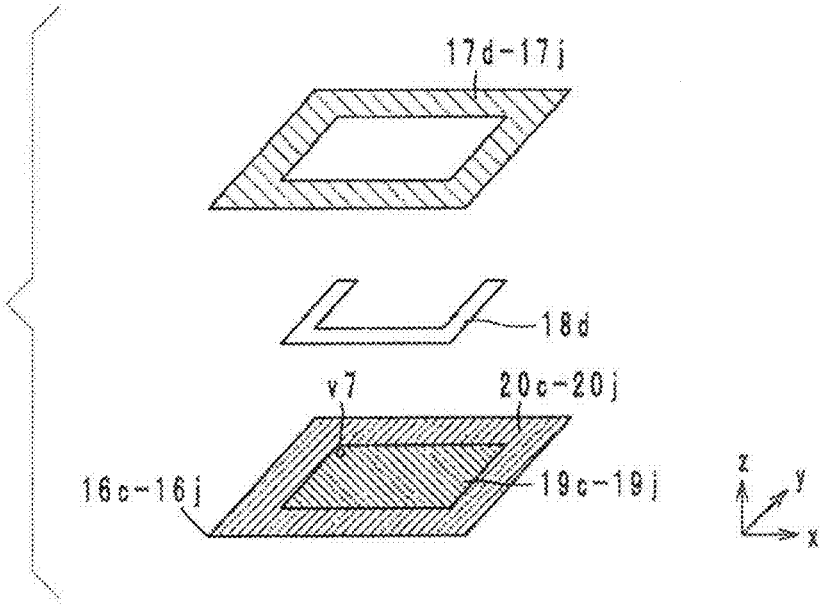
FIG. 3B is an exploded perspective view of a seventh magnetic layer of the laminate shown in FIG. 2.
Figure 3C:
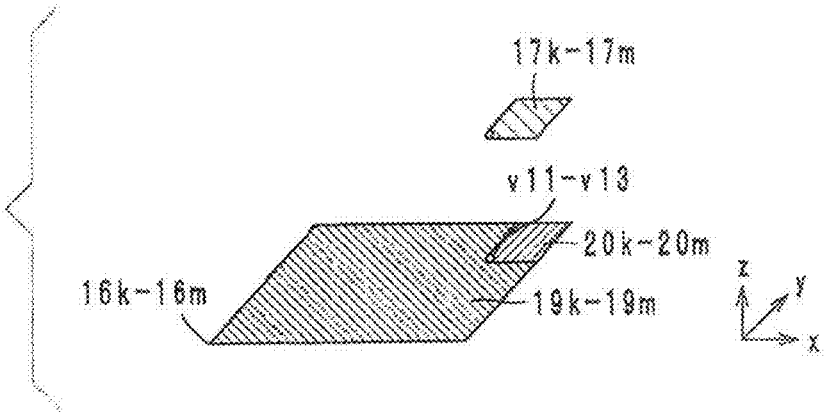
FIG. 3C is an exploded perspective view of an eleventh magnetic layer of the laminate shown in FIG. 2.
Figure 4:
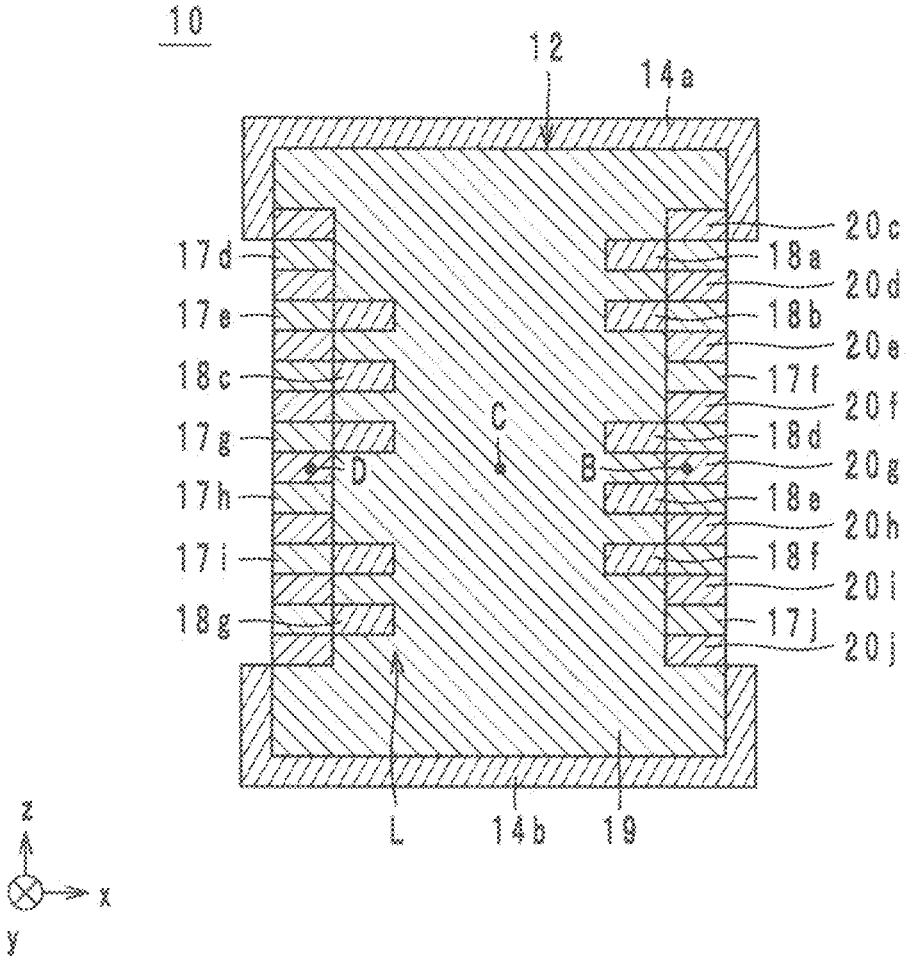
FIG. 4 is a sectional view of the electronic component taken along line A-A in FIG. 1 and viewed in the direction indicated by arrows.

The structure of an electronic component according to an exemplary embodiment of the present invention will now be described. FIG. 1 is an external perspective view of an electronic component 10 according to an exemplary embodiment. FIG. 2 is an exploded perspective view of a laminate 12 of the electronic component 10 shown in FIG. 1. FIG. 3A is an exploded perspective view of a magnetic layer 16*a* of the laminate 12 shown in FIG. 2. FIG. 3B is an exploded perspective view of a magnetic layer 16*g* of the laminate 12 shown in FIG. 2. FIG. 3C is an exploded perspective view of a magnetic layer 16*k* of the laminate 12 shown in FIG. 2. FIG. 4 is a sectional view of the electronic component 10 taken along line A-A in FIG. 1 and viewed in the direction indicated by arrows.

Hereinafter, the stacking direction of the electronic component 10 is defined as a z-axis direction. A direction in which long sides of a surface of the electronic component 10 in a positive z-axis direction extend is defined as an x-axis direction. A direction in which short sides of a surface of the electronic component 10 in a positive z-axis direction extend is defined as a y-axis direction. The x-axis direction, the y-axis direction, and the z-axis direction are orthogonal to one another.

As shown in FIGS. 1 and 2, the electronic component 10 includes the laminate 12, a plurality of outer electrodes 14 (illustrated are first and second outer electrodes 14*a* and 14*b*), a plurality of connecting portions 30 (illustrated are first and second connecting portions 30*a* and 30*b*), and a coil L.

As shown in FIG. 1, the laminate 12 has a rectangular parallelepiped shape and includes the coil L incorporated therein. In the laminate 12, surfaces located on both ends in the z-axis direction are referred to as an upper surface and a lower surface, and each surface that connects the upper surface and the lower surface is referred to as a side surface. As shown in FIG. 2, the laminate 12 is formed by stacking a plurality of magnetic layers 16 (illustrated are first to thirteenth magnetic layers 16*a* to 16*m*) and a plurality of non-magnetic layers 17 (illustrated are first to thirteenth non-magnetic layers 17*a* to 17*m*).

The magnetic layers 16*a* to 16*m* are rectangular layers made of a magnetic material (e.g., Ni—Cu—Zn ferrite) and are arranged in that order in a direction from the positive z-axis direction side to the negative z-axis direction side. Hereinafter, a surface of each of the magnetic layers 16 on the positive z-axis direction side is referred to as a right side, and a surface of each of the magnetic layers 16 on the negative z-axis direction side is referred to as a back side.

The non-magnetic layers 17*a* to 17*m* are disposed on the right sides of the magnetic layers 16*a* to 16*m*, respectively. The non-magnetic layers 17*a* and 17*b* each have a rectangular shape and are respectively disposed on the corners of the magnetic layers 16*a* and 16*b*, the corners each being located on the negative x-axis direction side and on the positive y-axis direction side. The non-magnetic layers 17*c* to 17*j* are ring-shaped rectangular layers disposed along four sides of the respective magnetic layers 16*c* to 16*j*. The non-magnetic layers 17*k* to 17*m* each have a rectangular shape and are respectively disposed on the corners of the magnetic layers 16*k* to 16*m*, the corners each being located on the positive x-axis direction side and on the positive y-axis direction side. The non-magnetic layers 17 are layers containing glass. Specifically, the non-magnetic layers 17 are made of a mixed material of a non-magnetic material (e.g., Ba—Al—Si ceramic composition) and a borosilicate glass. The Ba—Al—Si ceramic composition is a material that does not shrink during the firing of the laminate 12. The softening point of a borosilicate glass is, for example, 800° C., which is lower than the firing temperature (e.g., 900° C.) of the laminate 12. Hereinafter, a surface of each of the non-magnetic layers 17 on the positive z-axis direction side is referred to as a right side, and a surface of each of the non-magnetic layers 17 on the negative z-axis direction side is referred to as a back side.

As shown in FIG. 1, the outer electrode 14*a* is disposed so as to cover the upper surface of the laminate 12. The outer electrode 14*b* is disposed so as to cover the lower surface of the laminate 12. Furthermore, the outer electrodes 14*a* and 14*b* are disposed so as to extend to certain portions of the side surfaces adjacent to the upper surface and lower surface, respectively. The outer electrodes 14*a* and 14*b* function as connecting terminals that electrically connect the coil L to a circuit outside the electronic component 10.

The coil L is incorporated in the laminate 12 and, as shown in FIG. 2, is constituted by a plurality of coil conductors 18 (illustrated are first to seventh coil conductors 18*a* to 18*g*) and a plurality of via-hole conductors v4 to v9. The coil L has a helical shape that is formed by connecting the coil conductors 18 to each other through the via-hole conductors v4 to v9, and has a coil axis parallel to the z-axis direction.

As shown in FIG. 2, the coil conductors 18*a* to 18*g* are disposed on the right sides of the magnetic layers 16*d* to 16*j*, respectively, and are angular U-shaped linear conductors that are arranged in a clockwise rotation manner when viewed in plan in the z-axis direction. More specifically, the number of turns of each of the coil conductors 18*a* to 18*g* is ¾ turns, and the coil conductors 18*a* to 18*g* are disposed along three sides of the magnetic layers 16*d* to 16*j*, respectively. The coil conductor 18*a* is disposed along three sides of the magnetic layer 16*d* other than a short side in the negative x-axis direction. The coil conductor 18*b* is disposed along three sides of the magnetic layer 16*e* other than a long side in the negative y-axis direction. The coil conductor 18*c* is disposed along three sides of the magnetic layer 16*f* other than a short side in the positive x-axis direction. The coil conductor 18*d* is disposed along three sides of the magnetic layer 16*g* other than a long side in the positive y-axis direction. The coil conductor 18*e* is disposed along three sides of the magnetic layer 16*h* other than a short side in the negative x-axis direction. The coil conductor 18*f* is disposed along three sides of the magnetic layer 16*i* other than a long side in the negative y-axis direction. The coil conductor 18*g* is disposed along three sides of the magnetic layer 16*j* other than a short side in the positive x-axis direction. The coil conductors 18*a* to 18*g* overlap one another to form a rectangular ring shape when viewed in plan in the z-axis direction.

Hereinafter, in each of the coil conductors 18, an end on the clockwise upstream side when viewed in plan from the positive z-axis direction side is defined as an upstream end, and an end on the clockwise downstream side is defined as a downstream end. The number of turns of the coil conductor 18 is not limited to ¾ turns, and thus may be, for example, ½ turns or ⅞ turns.

As shown in FIG. 2, the via-hole conductors v4 to v9 are disposed so as to penetrate through the magnetic layers 16*d* to 16*i* in the z-axis direction, respectively. More specifically, the via-hole conductor v4 penetrates through the magnetic layer 16*d* in the z-axis direction so as to connect the downstream end of the coil conductor 18*a* and the upstream end of the coil conductor 18*b*. The via-hole conductor v5 penetrates through the magnetic layer 16*e* in the z-axis direction so as to connect the downstream end of the coil conductor 18*b* and the upstream end of the coil conductor 18*c*. The via-hole conductor v6 penetrates through the magnetic layer 16*f* in the z-axis direction so as to connect the downstream end of the coil conductor 18*c* and the upstream end of the coil conductor 18*d*. The via-hole conductor v7 penetrates through the magnetic layer 16*g* in the z-axis direction so as to connect the downstream end of the coil conductor 18*d* and the upstream end of the coil conductor 18*e*. The via-hole conductor v8 penetrates through the magnetic layer 16*h* in the z-axis direction so as to connect the downstream end of the coil conductor 18*e* and the upstream end of the coil conductor 18*f*. The via-hole conductor v9 penetrates through the magnetic layer 16*i* in the z-axis direction so as to connect the downstream end of the coil conductor 18*f* and the upstream end of the coil conductor 18*g*.

The connecting portion 30*a* connects the outer electrode 14*a* and the upstream end of the coil conductor 18*a* and is constituted by the via-hole conductors v1 to v3. The via-hole conductors v1 to v3 penetrate through the magnetic layers 16*a* to 16*c* in the z-axis direction, respectively, and are connected to one another to form a single via-hole conductor. The via-hole conductors v1 to v3 are respectively disposed on the corners of the non-magnetic layers 17*a* to 17*c*, the corners each being located on the positive x-axis direction side and on the negative y-axis direction side.

The connecting portion 30*b* connects the outer electrode 14*b* and the downstream end of the coil conductor 18*g* and is constituted by the via-hole conductors v10 to v13. The via-hole conductors v10 to v13 penetrate through the magnetic layers 16*j* to 16*m* in the z-axis direction, respectively, and are connected to one another to form a single via-hole conductor. The via-hole conductors v11 to v13 are respectively disposed on the corners of the non-magnetic layers 17*k* to 17*m*, the corners each being located on the negative x-axis direction side and on the negative y-axis direction side of these magnetic layers.

As shown in FIG. 2, the non-magnetic layers 17*d* to 17*j* are in contact with the coil conductors 18*a* to 18*g*, respectively. More specifically, the non-magnetic layers 17*d* to 17*j* are respectively disposed on the magnetic layers 16*d* to 16*j*, on which the coil conductors 18*a* to 18*g* are disposed, so as to be located outside the rectangular ring shape formed by the coil conductors 18*a* to 18*g* when viewed in plan in the z-axis direction. Furthermore, the outer edges of the non-magnetic layers 17*d* to 17*j* are aligned with the outer edges of the magnetic layers 16*d* to 16*j*, respectively. Thus, the non-magnetic layers 17*d* to 17*j* each have a rectangular ring or annular shape. The non-magnetic layer 17*c* has the same shape as those of the non-magnetic layers 17*d* to 17*j*, and lies on the non-magnetic layers 17*d* to 17*j* while perfectly fitting or coincidingly overlapping with the non-magnetic layers 17*d* to 17*j* when viewed in plan in the z-axis direction.

The softening point of a borosilicate glass contained in the non-magnetic layers 17*a* to 17*m* is lower than the firing temperature of the laminate 12. Therefore, the borosilicate glass softens during firing of the laminate 12 and diffuses into portions, of the magnetic layers 16*a* to 16*m*, that are adjacent to the non-magnetic layers 17*a* to 17*m*, respectively. Thus, the magnetic permeability μ2 in the portions, of the magnetic layers 16*a* to 16*m*, that are adjacent to the non-magnetic layers 17*a* to 17*m*, respectively, (hereinafter referred to as "low-magnetic-permeability portions 20*a* to 20*m*" as shown in FIGS. 3A to 3C) is lower than the magnetic permeability μ1 in portions, of the magnetic layers 16*a* to 16*m*, that are not adjacent to the non-magnetic layers 17*a* to 17*m*, respectively (hereinafter referred to as "high-magnetic-permeability portions 19*a* to 19*m*" as shown in FIGS. 3A to 3C). For example, the magnetic permeability μ1 is 100 and the magnetic permeability μ2 is 3.

The shapes of the high-magnetic-permeability portions 19 and the low-magnetic-permeability portions 20 will be described in detail with reference to FIGS. 3A to 3C. As shown in FIG. 3A, the low-magnetic-permeability portions 20*a* and 20*b* have the same rectangular shape as those of the non-magnetic layers 17*a* and 17*b* and are respectively disposed on the corners of the magnetic layers 16*a* and 16*b*, the corners each being located on the negative x-axis direction side and on the positive y-axis direction side. This is because the low-magnetic-permeability portions 20*a* and 20*b* are formed through the diffusion of a borosilicate glass contained in the non-magnetic layers 17*a* to 17*c* that are in contact with the low-magnetic-permeability portions 20*a* and 20*b*. The high-magnetic-permeability portions 19*a* and 19*b* are portions other than the low-magnetic-permeability portions 20*a* and 20*b* in the magnetic layers 16*a* and 16*b*, respectively.

As shown in FIG. 3B, the low-magnetic-permeability portions 20*c* to 20*j* have the same rectangular ring shape as those of the non-magnetic layers 17*c* to 17*j* and are formed along four sides of the magnetic layers 16*c* to 16*j*, respectively. This is because the low-magnetic-permeability portions 20*c* to 20*j* are formed through the diffusion of a borosilicate glass contained in the non-magnetic layers 17*c* to 17*j* that are in contact with the low-magnetic-permeability portions 20*c* to 20*j*. The high-magnetic-permeability portions 19*c* to 19*j* are rectangular portions other than the low-magnetic-permeability portions 20*c* to 20*j* in the magnetic layers 16*c* to 16*j*, the rectangular portions being surrounded by the low-magnetic-permeability portions 20*c* to 20*j*, respectively. Note that the coil conductor 18*d* and the via-hole conductor v7, which are respectively provided on and in the magnetic layer 16*g*, are shown in FIG. 3B only for convenience as one exemplary coil conductor and via-hole.

As shown in FIG. 3C, the low-magnetic-permeability portions 20*k* to 20*m* have the same rectangular shape as those of the non-magnetic layers 17*k* to 17*m* and are respectively disposed on the corners of the magnetic layers 16*k* to 16*m*, the corners each being located on the positive x-axis direction side and on the positive y-axis direction side. This is because the low-magnetic-permeability portions 20*k* to 20*m* are formed through the diffusion of a borosilicate glass contained in the non-magnetic layers 17*k* to 17*m* that are in contact with the low-magnetic-permeability portions 20*k* to 20*m*. The high-magnetic-permeability portions 19*k* to 19*m* are portions other than the low-magnetic-permeability portions 20*k* to 20*m* in the magnetic layers 16*k* to 16*m*, respectively.

In the electronic component 10 having the above-described structure, when viewed in plan in the z-axis direction, a region outside the coil L in the laminate 12 is constituted by the non-magnetic layers 17 or the low-magnetic-permeability portions 20 having a magnetic permeability μ2 as shown in FIG. 4. Thus, the coil L has an open magnetic circuit structure.

An exemplary method for manufacturing the electronic component 10 will now be described with reference to the drawings.

First, ceramic green sheets to be formed into magnetic layers 16 are prepared. Specifically, ferric oxide ($Fe_2O_3$), zinc oxide (ZnO), nickel oxide (NiO), and copper oxide (CuO) in a certain ratio are inserted into a ball mill as raw materials to perform wet mixing. The resultant mixture is dried and then reduced to powder. The powder is calcined at 800° C. for one hour. The calcined powder is subjected to wet grinding with a ball mill, dried, and then disintegrated to obtain a ferrite ceramic powder.

A binder (e.g., vinyl acetate and water-soluble acrylic), a plasticizer, a humectant, and a dispersant are added to the ferrite ceramic powder, and mixing is performed using a ball mill. Subsequently, defoaming is performed under reduced pressure to obtain a magnetic ceramic slurry. The magnetic ceramic slurry is applied onto a carrier sheet in a sheet-like shape by a doctor blade method and dried. Thus, each of ceramic green sheets to be formed into magnetic layers 16 is prepared.

Next, via-hole conductors v1 to v13 are formed in the respective ceramic green sheets to be formed into magnetic layers 16. Specifically, a via hole is made by irradiating, with a laser beam, each of the ceramic green sheets to be formed into magnetic layers 16. The via hole is then filled with a paste made of a conductive material such as Ag, Pd, Cu, Au, or an alloy thereof by a printing method or the like. Thus, via-hole conductors v1 to v13 are formed.

Next, a paste made of a conductive material is applied onto each of the ceramic green sheets to be formed into magnetic layers 16*d* to 16*j* by a method such as screen printing or photolithography to form coil conductors 18. The paste made of a conductive material is obtained by adding a varnish and a solvent to Ag.

A step of forming coil conductors 18 and a step of filling via holes with a paste made of a conductive material may be performed in the same process.

Next, a borosilicate glass powder and a varnish are mixed with a Ba—Al—Si ceramic composition powder to prepare a non-magnetic ceramic paste. The volume ratio of the Ba—Al—Si ceramic composition powder to the borosilicate glass powder is, for example, 30:70. The prepared non-magnetic ceramic paste is applied onto each of the ceramic green sheets to be formed into magnetic layers 16 by screen printing. Thus, non-magnetic layers 17 having the shapes shown in FIG. 2 are formed.

Next, the ceramic green sheets to be formed into magnetic layers 16 are stacked and temporarily pressure-bonded one by one to obtain a green mother laminate. Specifically, the ceramic green sheets to be formed into magnetic layers 16 are stacked and temporarily pressure-bonded one by one. Subsequently, permanent pressure bonding is performed on the green mother laminate by isostatic pressing. The pressure in the permanent pressure bonding is, for example, 1000 kgf/$cm^2$.

Next, the green mother laminate is cut into a plurality of green multilayer bodies 12 having the predetermined size. The green multilayer bodies 12 are subjected to debinding and firing treatments. For example, the firing temperature is 900° C. and the firing time is two hours. Herein, the softening point of the borosilicate glass contained in the non-magnetic layers 17 is 800° C., which is lower than the firing temperature. Therefore, the borosilicate glass contained in the non-magnetic layers 17 melts during the firing and diffuses into portions of magnetic layers 16 that are adjacent to the non-magnetic layers 17. The borosilicate glass prevents the sintering of ferrite ceramic. Therefore, the sintering of ferrite ceramic does not easily proceed in the portions into which the borosilicate glass has diffused compared with portions into which the borosilicate glass does not diffuse, and the ferrite grain size is decreased. As a result, low-magnetic-permeability portions 20 having a low magnetic permeability μ2 are formed.

Subsequently, the surface of each of the multilayer bodies 12 is subjected to barrel polishing to perform chamfering.

Next, an electrode paste made of a conductive material mainly composed of Ag is applied onto the upper surface and lower surface of the laminate 12. The applied electrode paste is baked at about 750° C. for one hour to form silver electrodes to serve as outer electrodes 14. Furthermore, Ni plating and Sn plating are performed on the surfaces of the silver electrodes to form outer electrodes 14. Through the steps described above, an electronic component 10 is completed.

According to the exemplary electronic component 10 and the exemplary method for manufacturing the electronic component 10 described above, excellent direct-current superposition characteristics can be achieved. More specifically, in the electronic component 10, the non-magnetic layers 17 containing a borosilicate glass whose softening point is lower than the firing temperature of the laminate 12 are disposed in the laminate 12. Therefore, the borosilicate glass diffuses from the non-magnetic layers 17 to the magnetic layers 16 during the firing of the laminate 12, and the low-magnetic-permeability portions 20 are formed. Thus, in the electronic component 10, not only the non-magnetic layers 17, but also the low-magnetic-permeability portions 20 contribute to a reduction in the generation of magnetic saturation. Consequently, according to the electronic component 10 and the method for manufacturing the electronic component 10, excellent direct-current superposition characteristics can be achieved.

In the exemplary method for manufacturing the electronic component 10, the electronic component 10 having an open magnetic circuit structure can be obtained by a sheet stacking method. More specifically, in the method for manufacturing the electronic component 10, the non-magnetic layers 17 are formed by applying a non-magnetic ceramic paste in a region outside the ring shape formed by the coil conductors 18 when viewed in plan in the z-axis direction. The portions, of the magnetic layers 16, that are adjacent to the non-magnetic layers 17 are changed into the low-magnetic-permeability portions 20 in the firing. Therefore, in the electronic component 10, when viewed in plan in the z-axis direction, a region outside the coil L is constituted by the non-magnetic layers 17 or the low-magnetic-permeability portions 20 as shown in FIG. 4. Thus, the coil L has an open magnetic circuit structure.

The inventor of the present application conducted experiments, described below, in order to further clarify the advantages provided by the electronic component 10.

Figure 5:
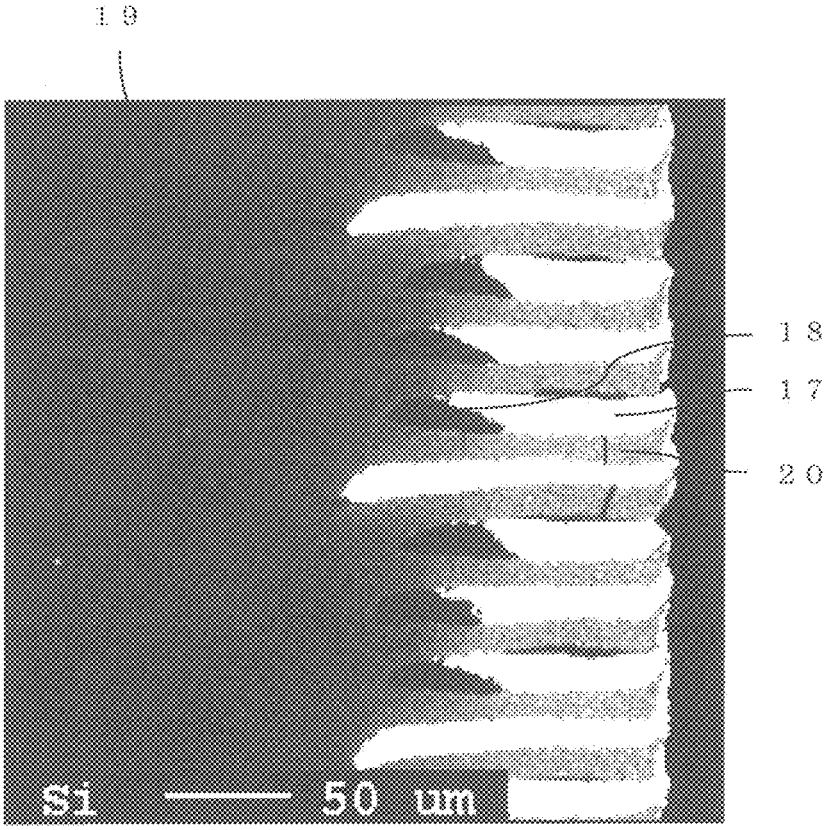
FIG. 5 is an image showing the diffusion of Si around a point B of the electronic component.

In a first experiment, the diffusion of a borosilicate glass in the electronic component 10 was observed by field emission-wavelength dispersive X-ray spectroscopy (FE-WDX) (name of equipment: JXA-8500F manufactured by JEOL Ltd.). FIG. 5 is an image showing the diffusion of Si around a point B (refer to FIG. 4) of the electronic component 10. The white portion means that the amount of Si (i.e., borosilicate glass) is large and the black portion means that the amount of Si (i.e., borosilicate glass) is small. As is clear from FIG. 4, the borosilicate glass has diffused from the non-magnetic layers 17 into the magnetic layers 16 located around the non-magnetic layers 17.

Figure 6A:
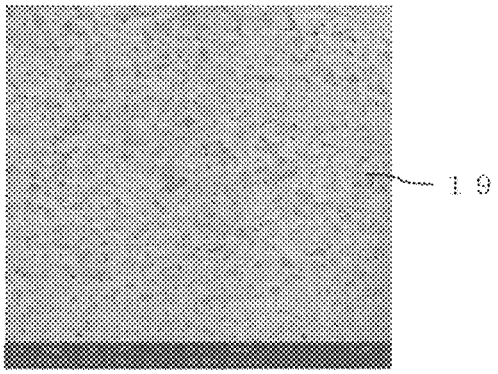
FIG. 6A is an image showing a region around a point C shown in FIG. 4.
Figure 6B:
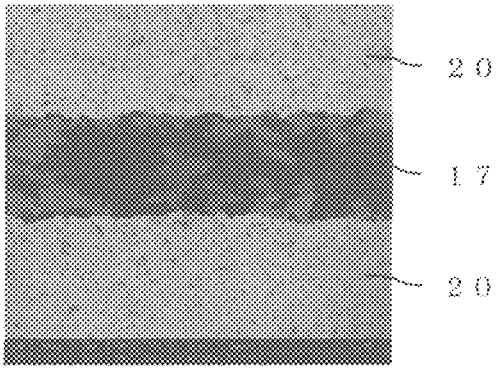
FIG. 6B is an image showing a region around a point D shown in FIG. 4.

In a second experiment, the ferrite grain size around points C and D (refer to FIG. 4) of the electronic component 10 was observed. FIG. 6A is a micrograph showing a region around the point C and FIG. 6B is a micrograph showing a region around the point D. As is clear from FIGS. 6A and 6B, the ferrite grain size in the high-magnetic-permeability portions 19 is larger than that in the low-magnetic-permeability portions 20.

It is found from the first and second experiments that the ferrite grain size in the low-magnetic-permeability portions 20 is decreased through the diffusion of the borosilicate glass into the low-magnetic-permeability portions 20, and the magnetic permeability μ2 of the low-magnetic-permeability portions 20 is decreased.

In a third experiment, in the electronic component 10 including a coil L with 15 turns, the inductance-decreasing ratio and the chip strength were measured by changing the volume ratio between a Ba—Al—Si ceramic composition and a borosilicate glass. The inductance-decreasing ratio is a ratio of an inductance value obtained when 400 mA is applied to an inductance value obtained when 0 mA (in reality, several milliamperes) is applied. The frequency of electric current was 100 MHz. The inductance value was measured using E4991A manufactured by Agilent. The chip strength is the magnitude of external force that causes damage on the electronic component 10 when a load is imposed on the electronic component 10 at a rate of 0.5 mm/s using a special jig. Table 1 shows the results of the experiment. Here, "—" in Table 1 means that it is impossible to manufacture an electric component 10 having a Ba—Al—Si ceramic composition with 100% volume ratio.

TABLE 1

| VOLUME RATIO [%] | | | |
|---|---|---|---|
| Ba—Al—Si CERAMIC COMPOSITION | BORO-SILICATE GLASS | INDUCTANCE-DECREASING RATIO [%] | CHIP STRENGTH [N] |
| 0 | 100 | 7.1 | 13.3 |
| 10 | 90 | 7.8 | 15.4 |
| 30 | 70 | 10.1 | 21.5 |
| 50 | 50 | 16.3 | 20.8 |
| 70 | 30 | 32.9 | 19.6 |
| 90 | 10 | 48.1 | 10.5 |
| 100 | 0 | — | — |

As is clear from Table 1, the decrease in an inductance value is further suppressed as the ratio of the borosilicate glass contained in the non-magnetic layers 17 increases. This means that, as the ratio of the borosilicate glass contained in the non-magnetic layers 17 increases, the low-magnetic-permeability portions 20 are formed through the diffusion of the borosilicate glass and the direct-current superposition characteristics are further improved. The ratio of the borosilicate glass is preferably 30% or more and 70% or less by volume. This is because, if the ratio of the borosilicate glass is less than 30% by volume or more than 70% by volume, the chip strength is decreased.

In a fourth experiment, in the electronic component 10 that uses Cu—Zn ferrite instead of the Ba—Al—Si ceramic composition, the inductance-decreasing ratio and the chip strength were measured by changing the volume ratio between Cu—Zn ferrite and a borosilicate glass. The Cu—Zn ferrite is a material that shrinks during the firing of the laminate 12. Table 2 shows the results of the experiment. In Table 2, the electronic component containing 0% by volume of borosilicate glass corresponds to an existing electronic component.

TABLE 2

| VOLUME RATIO [%] | | INDUCTANCE- | CHIP |
|---|---|---|---|
| Cu—Zn FERRITE | BOROSILICATE GLASS | DECREASING RATIO [%] | STRENGTH [N] |
| 0 | 100 | 7.1 | 13.3 |
| 10 | 90 | 8.1 | 15.5 |
| 30 | 70 | 13.1 | 21.3 |
| 50 | 50 | 23.2 | 21.2 |
| 70 | 30 | 40.1 | 21.8 |
| 90 | 10 | 54.1 | 22.8 |
| 100 | 0 | 63.1 | 23.1 |

As is clear from Table 2, the decrease in an inductance value is further suppressed as the ratio of the borosilicate glass contained in the non-magnetic layers 17 increases. This means that, as the ratio of the borosilicate glass contained in the non-magnetic layers 17 increases, the low-magnetic-permeability portions 20 are formed through the diffusion of the borosilicate glass and the direct-current superposition characteristics are further improved. The ratio of the borosilicate glass is preferably 50% or more and 70% or less by volume. This is because, if the ratio of the borosilicate glass is less than 50% by volume, only a small effect of suppressing the decrease in an inductance value is produced. Furthermore, if the ratio is more than 70% by volume, the chip strength is decreased.

It is also found from the comparison between Table 1 and Table 2 that, when the ratio of the borosilicate glass is the same, the electronic component 10 that uses the Ba—Al—Si ceramic composition has better direct-current superposition characteristics than the electronic component 10 that uses Cu—Zn ferrite. This is because, in the electronic component 10 that uses Cu—Zn ferrite, Ni in the magnetic layers 16 diffuses into the non-magnetic layers 17 during the firing of the laminate 12 and part of the non-magnetic layers 17 changes into magnetic layers.

Figure 7:
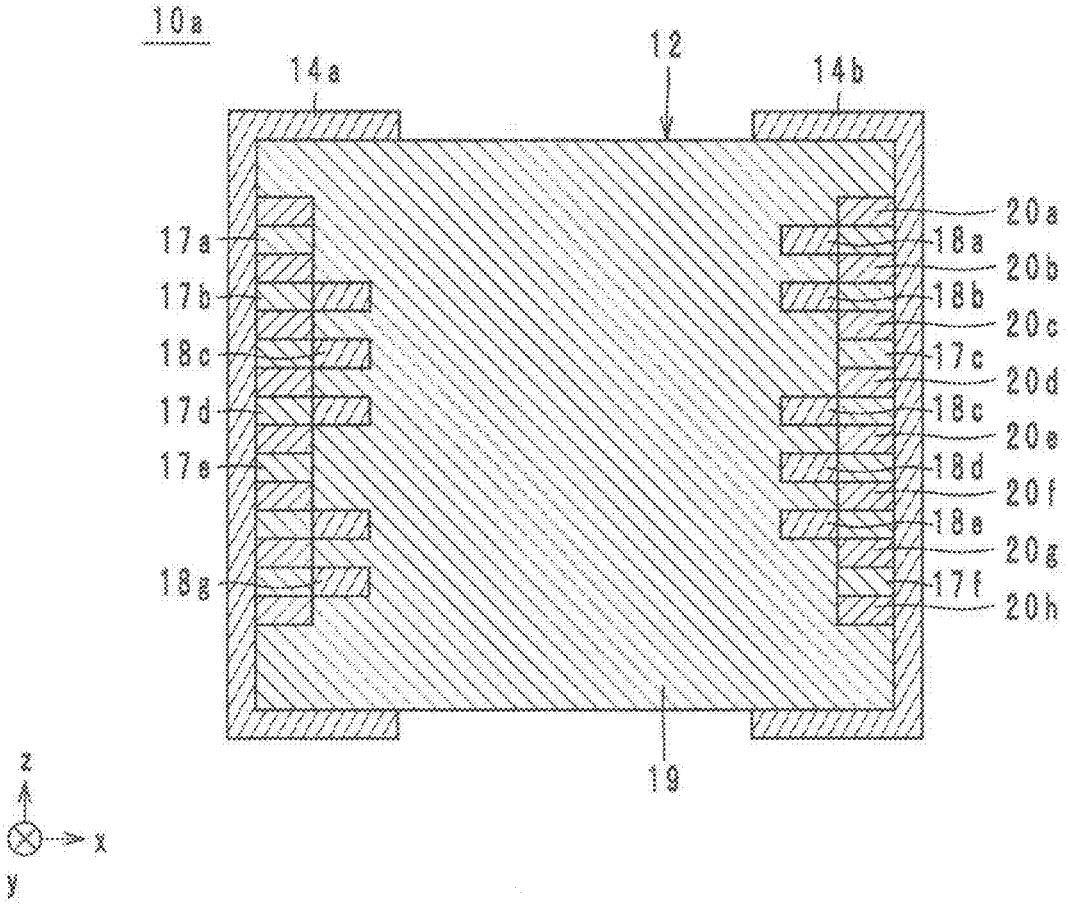
FIG. 7 is a sectional view showing a structure of an electronic component according to a first exemplary modification.

An electronic component according to a first exemplary modification will now be described with reference to the drawings. FIG. 7 is a sectional view showing a structure of an electronic component 10*a* according to the first modification.

The difference between the electronic component 10*a* and the electronic component 10 is a position of the outer electrodes 14*a* and 14*b*. More specifically, in the electronic component 10*a*, the outer electrode 14*a* is disposed on a side surface of the laminate 12 on the negative x-axis direction side and the outer electrode 14*b* is disposed on a side surface of the laminate 12 on the positive x-axis direction side. The electronic component 10*a* having the structure above can also produce the advantages similar to those of the electronic component 10.

In the electronic component 10*a*, the coil L is not connected to the outer electrodes 14*a* and 14*b* through via-hole conductors. The coil conductor 18*a* is connected to the outer electrode 14*a* through a connecting conductor (not shown), the connecting conductor and the coil conductor 18*a* being formed in an integrated manner. The coil conductor 18*g* is connected to the outer electrode 14*b* through a connecting conductor (not shown), the connecting conductor and the coil conductor 18*g* being formed in an integrated manner.

Figure 8:
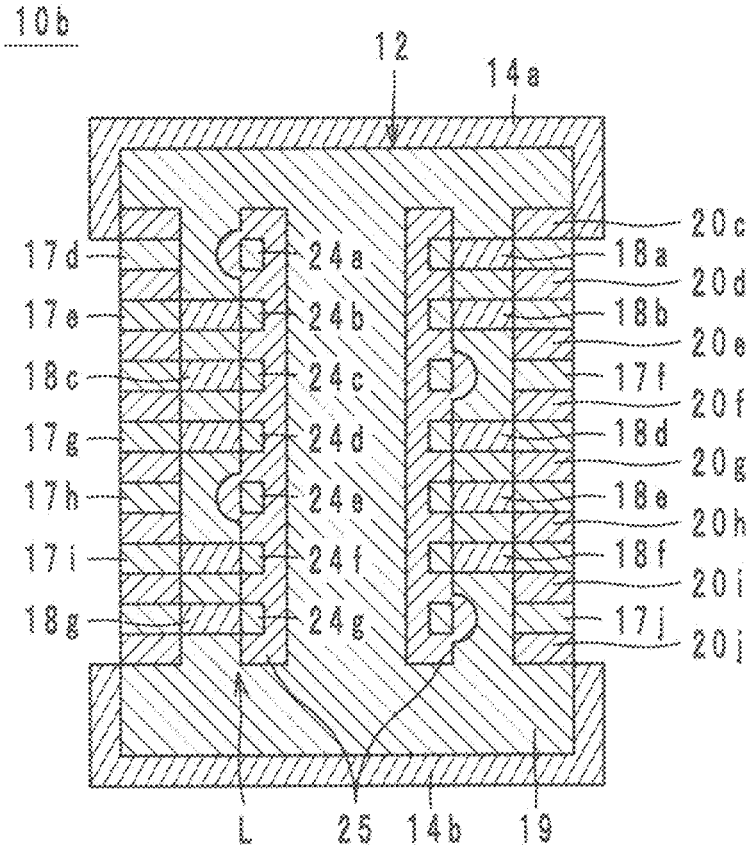
FIG. 8 is a sectional view showing a structure of an electronic component according to a second exemplary modification.

An electronic component according to a second modification will now be described with reference to the drawings. FIG. 8 is a sectional view showing a structure of an electronic component 10*b* according to the second modification.

The difference between the electronic component 10*b* and the electronic component 10 is that, in the electronic component 10*b*, non-magnetic layers 24*a* to 24*g* are added. More specifically, the non-magnetic layers 24*a* to 24*g* are disposed inside the coil conductors 18*a* to 18*g*, respectively. As a result, low-magnetic-permeability portions 25 are formed around the non-magnetic layers 24*a* to 24*g*. The electronic component 10*b* having the structure above can also produce the advantages similar to those of the electronic component 10.

Figure 9:
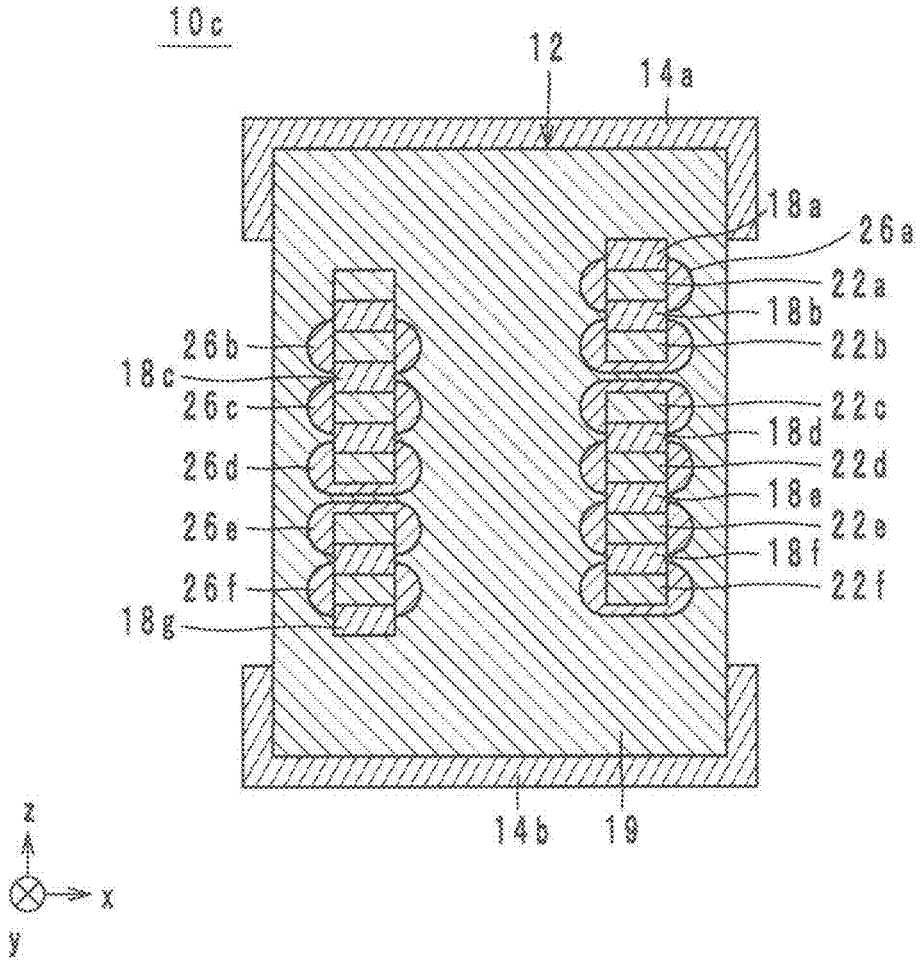
FIG. 9 is a sectional view showing a structure of an electronic component according to a third exemplary modification.
Figure 10:
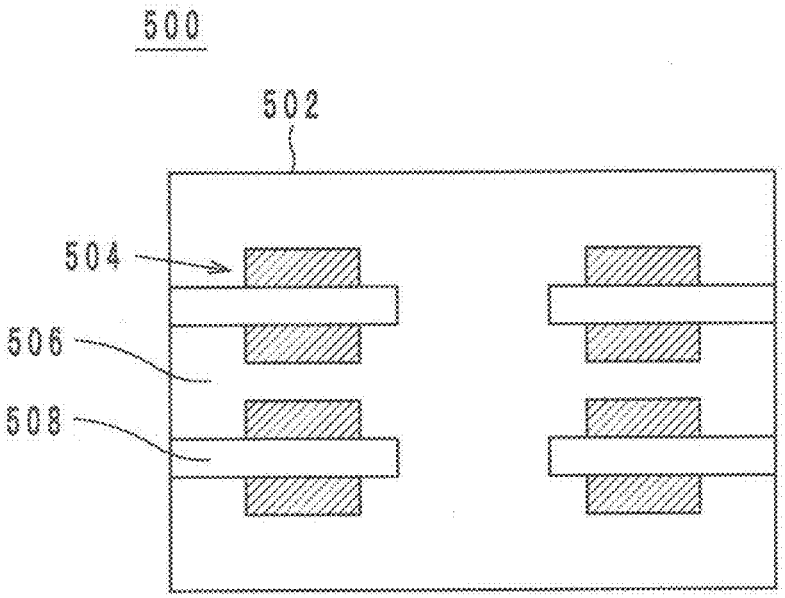
FIG. 10 PRIOR ART
FIG. 10 is a sectional view showing a structure of a conventional multilayer inductor.

An electronic component according to a third exemplary modification will now be described with reference to the drawings. FIG. 9 is a sectional view showing a structure of an electronic component 10*c* according to the third modification.

The difference between the electronic component 10*c* and the electronic component 10 is that, in the electronic component 10*c*, non-magnetic layers 22*a* to 22*f* are disposed below the coil conductors 18*a* to 18*f*, respectively, so that each of the non-magnetic layers is sandwiched between two of the coil conductors. As a result, low-magnetic-permeability portions 26*a* to 26*f* are formed around the non-magnetic layers 22*a* to 22*f*, respectively. The electronic component 10*c* having the structure above can also produce the advantages similar to those of the electronic component 10.

Embodiments of an electronic component according to the present disclosure and a method for manufacturing the electronic component according to the present disclosure are not limited to the electronic components 10 and 10*a* to 10*c* according to the above-described exemplary embodiments, and can be modified without departing from the scope of the disclosure.

For example, in the embodiment shown in FIG. 2, it has been described that the non-magnetic layers 17*a* to 17*m* are disposed on the right sides of the magnetic layers 16*a* to 16*m*, respectively. However, even in a structure in which a non-magnetic layer 17 is disposed on at least one of the plurality of magnetic layers 16, the advantages can be produced to some extent.

It has been described that the electronic component 10 is produced by a sheet stacking method in which the magnetic layers 16 are formed using green sheets. However, the electronic component 10 may be produced by, for example, a printing method.

What is claimed is:

1. An electronic component comprising:

a laminate in which magnetic layers and at least one non-magnetic layer are stacked, the at least one non-magnetic layer containing Cu—Zn ferrite and borosilicate glass; and a coil incorporated in the laminate, wherein a ratio of the borosilicate glass to the non-magnetic layer is not less than 50% and not more than 70% by volume, a ratio of the Cn—Zn ferrite to the non-magnetic layer is not less than 30% and not more than 50% by volume, and a second magnetic permeability in portions of the magnetic layers which are adjacent to the non-magnetic layer is lower than a first magnetic permeability in portions of the magnetic layers which are not adjacent to the non-magnetic layer, by diffusion of the glass from the non-magnetic layer into the magnetic layers.

2. The electronic component according to claim 1, wherein the coil has a helical shape with a coil axis parallel to a stacking direction, the helical shape being formed by connecting a plurality of coil conductors respectively provided on the magnetic layers, and the non-magnetic layer is on each of the magnetic layers, on which the coil conductors are provided, so as to be located outside a ring shape formed by the coil conductors when viewed in plan in the stacking direction.

* * * * *